US006414212B1

(12) United States Patent
Gonzalez et al.

(10) Patent No.: US 6,414,212 B1
(45) Date of Patent: Jul. 2, 2002

(54) METHOD FOR DECONTAMINATION OF LOW LEVEL POLYHALOGENATED AROMATIC CONTAMINATED FLUID AND SIMULTANEOUS DESTRUCTION OF HIGH LEVEL POLYHALOGENATED AROMATICS

(75) Inventors: Luciano A. Gonzalez, Ancaster; Henry E. Kowalyk, Burlington; Blair F. Sim, Brampton, all of (CA)

(73) Assignee: Kinectrics, Inc., Toronto (CA)

( * ) Notice: Subject to any disclaimer, the term of this patent is extended or adjusted under 35 U.S.C. 154(b) by 0 days.

(21) Appl. No.: 09/641,568

(22) Filed: Aug. 18, 2000

(51) Int. Cl.[7] ..... A62D 3/00
(52) U.S. Cl. ..... 588/207; 588/248
(58) Field of Search ..... 588/206, 207, 588/248; 585/6.3, 6.6; 252/581

(56) References Cited

U.S. PATENT DOCUMENTS

| | | | | |
|---|---|---|---|---|
| 4,337,368 A | * | 6/1982 | Pytlewski et al. | 568/730 |
| 4,340,471 A | | 7/1982 | Jordan | |
| 4,377,471 A | | 3/1983 | Brown et al. | |
| 4,379,746 A | | 4/1983 | Norman et al. | |
| 4,379,752 A | | 4/1983 | Norman | |
| 4,416,767 A | | 11/1983 | Jordan | |
| 4,417,977 A | * | 11/1983 | Pytlewski et al. | 208/262 |
| 4,447,667 A | * | 5/1984 | Parker et al. | 585/469 |
| 4,514,294 A | | 4/1985 | Layman et al. | |
| 4,592,844 A | | 6/1986 | Layman et al. | |
| 4,639,309 A | | 1/1987 | Lalancette et al. | |
| 4,853,040 A | | 8/1989 | Mazur et al. | |
| 4,950,833 A | | 8/1990 | Hawari et al. | |
| 5,185,488 A | | 2/1993 | Hawari et al. | |

FOREIGN PATENT DOCUMENTS

| | | |
|---|---|---|
| CA | 2062054 | 9/1992 |

* cited by examiner

*Primary Examiner*—Steven P. Griffin
*Assistant Examiner*—Edward M. Johnson
(74) *Attorney, Agent, or Firm*—Nixon & Vanderhye

(57) ABSTRACT

Methods are provided for the dehalogenation of halogenated aromatics whereby an inert solvent, an alkali dispersion and high level contaminated material is placed in a vessel, and a low level contaminated inert fluid is then added as a coolant to maintain the temperature below the flash point during the reaction. The low level contaminated fluid is also decontaminated. Typically, the alkali by-product is then neutralized with water. Also taught is the use of water contaminated inert fluids as coolants for the reaction.

20 Claims, No Drawings

METHOD FOR DECONTAMINATION OF LOW LEVEL POLYHALOGENATED AROMATIC CONTAMINATED FLUID AND SIMULTANEOUS DESTRUCTION OF HIGH LEVEL POLYHALOGENATED AROMATICS

FIELD OF THE INVENTION

The invention relates to methods for dehalogenation of polyhalogenated aromatics using alkali dispersion.

BACKGROUND OF THE INVENTION

Polyhalogenated aromatics such as polychlorinated biphenyls (PCBs) are toxic materials that have been widely used in the utility industry. Because of environmental and health concerns, the production of PCBs was banned in the late seventies and their use strictly regulated. Moreover, extensive programs to remove and destroy PCBs have been established.

Although, in the utility industry, PCBs are mainly found in PCB-made equipment such capacitors and power transformers, they are also found in contaminated mineral oil used in transformers switchgears and other electrical equipment. In PCB-made equipment such as power correction capacitors, the PCB level found in the dielectric fluid is usually near 100%. In power transformers however, the PCB level is in the range of 40 to 60% with the balance of the dielectric fluid being a mixture of chlorobenzenes. The level of PCBs in the PCB contaminated equipment (mainly transformer) is usually in the range of 50 to 1,000 ppm.

Although incineration has been the most commonly used means for the destruction of PCBs, a number of chemical processes have been developed as disposal alternative for this type of wastes. The scientific and patent literature provides an extremely broad array of processes aimed at dehalogenating organic halides. For example, U.S. Pat. No. 4,379,746 to Norman et al. discloses a process for the destruction of PCBs wherein the PCBs are continuously re-circulated in an inert liquid medium and a sodium dispersion reagent is injected into the circulating liquid. U.S. Pat. 4,639,309 to Lalancette et al. discloses a method wherein an inert surface is coated with a dispersion of sodium or potassium and said surface reacts with the halogen of a polyhalogenated hydrocarbon. Canadian Patent 2,062,054 discloses a method for the destruction of high level PCB liquid wastes using a combination of distillation and sodium dispersion reagent. U.S. Pat. No. 5,185,488 to Hawari et al discloses forming a sodium dispersion and adding askarel dissolved in a lower aliphatic alcohol. Other alkali based processes for the dechlorination of PCBs are described in U.S. Pat. Nos. 4,340,471 and 4,416,767 to Jordan; U.S. Pat. Nos. 4,514,294 and 4,592,844 to Layman et al; U.S. Pat. No. 4,853,040 to Mazur et al; U.S. Pat. No. 4,950,833 to Hawari et al; U.S. Pat. No. 4,377,471 to Brown et al; and U.S. Pat. No. 4,379,752 to Norman.

The use of chemical processes for the disposal of toxic chemicals is limited by economic and safety factors. As the concentration of the toxic contaminant in the waste stream increases the amount of reagent required to destroy the material increases making the process more expensive to operate. This results in an economically disadvantaged disposal option. Because of these factors, particularly in the PCB disposal business, chemical options for the disposal of this waste has been limited to concentrations below 10,000 mg/kg.

In addition to the economic disadvantage of chemical processes for the destruction of toxic wastes, heat generated by commonly known destruction reaction results in an increase in the reactants' temperature. The temperature increase usually surpasses the flash point of the media (normally mineral oil), creating a potentially unsafe condition.

SUMMARY OF THE INVENTION

The present invention utilizes a novel process for decontaminating a contaminated inert fluid which is contaminated with a low level of polyhalogenated aromatic while simultaneously decontaminating a material which is contaminated with a high level of polyhalogenated aromatic, by an exothermic polyhalogenated aromatic destroying reaction. The method comprises: (i) placing in a vessel (a) an inert solvent; (b) an alkali dispersion; and (c) the high level contaminated material; a second step of (ii) substantially contemporaneous with the conclusion of step (i), adding to the contents of the vessel the contaminated inert fluid in a quantity sufficient to maintain temperature of the contents below flash point of the contents; and (iii) allowing a reaction between the alkali dispersion and the polyhalogenated aromatics to proceed until the contaminated inert fluid and the material are decontaminated to produce decontaminated inert fluid.

In one embodiment, the method further comprises, during step (iii), removing a sample from the contents and analyzing the sample to determine whether all polyhalogenated aromatics are destroyed. In another embodiment, the method further comprises substantially contemporaneous or subsequent to steps (ii) and (iii), the steps of (iv) placing water in the vessel to neutralize the contents and (v) placing inert fluid in the vessel, in a quantity sufficient to maintain the temperature of the contents below flash point of the contents. In a further embodiment, at least part of the water is in the inert fluid.

A further embodiment teaches, during step (ii), contaminated inert fluid is added into the vessel in a quantity sufficient to maintain temperature of the contents below a temperature that would denature the inert fluid, and, subsequent to step (iii), recovering the inert fluid as useable inert fluid. In a related embodiment, the useable inert fluid is recovered by, subsequent to step (iii), allowing reactants to settle out of the inert fluid and subsequently recovering the useable inert fluid.

The method may further comprise, prior to steps (iv) and (v), adding clean inert fluid to further cool contents of the vessel.

The method may further comprise, prior to conclusion of step (i), air is displaced from the vessel. The air may be displaced with a non-combustible gas.

In an embodiment, the inert solvent is contaminated with a low level of polyhalogenated aromatic.

In another embodiment, the alkali dispersion is obtained from an alkali selected from the group consisting of lithium, potassium and sodium. The polyhalogenated aromatic may be selected from the group consisting of polychlorinated biphenyls, polybrominated biphenyls, halogenated benzenes, halogenated biphenyls, polychlorinated dibenzofurnas, chlordane and halogenated polynuclear aromatics. The polyhalogenated aromatic may be PCB. In a further embodiment, prior to conclusion of step (i), the contents are heated to about 90° C. In an embodiment, during step (ii), the temperature is maintained below about 140° C.

In an embodiment the inert solution is organic solvent. In a further embodiment, the organic solvent is mineral oil.

DETAILED DESCRIPTION OF THE PREFERRED EMBODIMENT

The present invention describes innovative, economical and safe means for the simultaneous destruction of both high and low level polyhalogenated aromatics. The invention teaches methods for the simultaneous dehalogenation of polyhalogenated aromatics in both high and low level wastes using an exothermic chemical reaction and the use of low level polychlorinated aromatic contaminated oil and/or wet clean mineral oil as both cooling medium for the reacting mixture and as a material which is decontaminated in the process.

Although the method is described as applied to the destruction of PCBs using an alkali dispersion, the methodology employed is also applicable to other chemical processes. Since the method allows for absorbing the heat generated by a high level PCB reactions using low level contaminated fluids, the method can be applied to other exothermic decontamination reactions. Examples of such exothermic detoxification reactions include destruction of high level PCBs with a mixture of polyethylene glycol and potassium hydroxide, and destruction of Chlordane (or other chlorinated pesticides) with metallic sodium. Examples of other suitable polyhalogenated biphenyls and alkali dispersions which may be used to destroy them are set out below.

In one method of the invention, low level PCB contaminated mineral oil is pre-heated and loaded into a reaction vessel. Any air head is displaced to avoid a potentially explosive situation later in the process (i.e. oxygen is removed). The air may be displaced by the introduction of a chemically unreactive gas such as helium or nitrogen.

After replacing the air head with a nitrogen blanket and reaching the required reaction temperature, sodium dispersion or equivalent reactant is added into the reaction vessel. High level PCBs or equivalent waste stream in then added into the reaction vessel. As the PCB-sodium reaction takes place, temperature of the reactants in the vessel increases. To maintain the temperature within safety margin (below flash point), low level PCB contaminated mineral oil at room temperature is added into the blend. Although the trace amount of PCBs in the mineral oil would create additional heat as it reacts with sodium in the blend, the much lower temperature of this mineral oil is sufficient to produce a net decrease in the reactant blend. The addition of high level PCB waste and low level PCB contaminated oil as a cooling medium continues until all high level waste intended to be destroyed in the batch is completed.

Samples are taken and analysis is performed on the samples to ensure that PCBs are destroyed. By "destroyed" it is meant that one must ensure PCBs are destroyed to the level required by local legislation. The level changes from jurisdiction to jurisdiction. For example, in Canada and USA the set level is less than 2 mg/kg (ppm), while in Japan it is less than 0.5 mg/kg. Any analytical procedure known in the art may be used. For example, GC-ECD may be used. As a summary of the procedure, the oil sample is diluted with isooctane and extracted with acetonitrile. PCB and polar components partition into the acetonitrile. The acetonitrile is then blown down with nitrogen and the extract reconstituted in isooctane followed by two sulphuric acid washings and finally cleaned up on a florisil column (1g). Low level standards are prepared by weighing a 2 mg/Kg PCB in oil standard and serially diluting with oil which had been previously treated with sodium. The working concentration is approximately 0.1 and 0.2 mg/Kg. The Na process clean oil is also reserved for the preparation of oil blanks. The prepared samples, blanks, and standards are transferred to autosampler vials and run on a gas chromatograph equipped with a capillary column and electron capture detector.

After confirming by analysis that PCBs have been destroyed in the reactor, the excess sodium used in the reaction is neutralized with water to form sodium hydroxide and hydrogen. Water is typically used because it is the least expensive neutralization reagent available. However, one could use other reagents, such as alcohols (e.g. isopropyl alcohol).

The sodium neutralization reaction with water is exothermic. Thus, to maintain temperature below the flash point, the operator may want to lower the temperature of the contents of the reaction vessel before the sodium-water neutralization. From a safety point of view this is important because hydrogen is also generated by the neutralization reaction, hence, one will want to reduce the risk of combustion as much as possible.

To absorb the heat produced by this neutralization reaction, previously clean oil with or without trace amounts of water at ambient temperature is added to the reaction vessel to maintain temperature within the safety margin. A benefit of the present method is that most polyhalogenated biphenyl contaminated oils contain at least some water as a contaminant. By the present method, this "contaminant" becomes a useful reactant, neutralizing the alkali product of the PCB destruction reaction. As it is known that any water in the oil would react with sodium, one skilled in the art would expect the fact that this is an exothermic reaction renders water contaminated oil worse than useless as a cooling fluid. However, the present inventors have found that, the heat generated is not enough to prevent the oil from being effective as a coolant in the reaction vessel. Although the trace amount of water that might be present in the clean cooling oil will react with sodium to generate additional heat, the lower temperature of the cooling oil is sufficient to produce a net decrease in the reaction mixture.

After the excess sodium is neutralized the clean by-product is removed from the reactor and loaded into a settling tank. The supernatant oil from this tank can subsequently be used to cool reaction mixtures.

Low level PCB contaminated oil can be substituted by wet, clean oil, creating the same effect in the reaction mixture. To eliminate the potential for cross contamination upon completion of the reaction cycle, PCB contaminated oil should not be used to cool down reacting mixture during or after neutralization of excess sodium.

Advantages of using the methods of the invention can include the following. First, the method allows one to destroy simultaneously two waste streams, high level and low level, saving reagent, time and increasing capacity of installed reactor system. Second, the use of low level contaminated oil or wet, clean oil as cooling fluid means that one does not need to build reactor systems that use external cooling systems (e.g. jacket or cooling tube), thus saving energy and system construction costs. Third, the method maintains reaction temperatures low enough that the cleaned oil is re-usable, unlike other known methods. Fourth, the method provides a beneficial use for low level PCB contaminated oil (as a coolant), as opposed to other methods, for which low level PCB contaminated oil is a waste product to be incinerated. Fifth, the method provides a beneficial use for water contaminated oil, as compared to other methods, for which ways must be found to remove water from oil prior to using the oil.

Polyhalogenated Biphenyls

Polyhalogenated aromatic compounds which may be dehalogenated by the process of the present invention include PCBs, as well as halogenated compounds used in pesticides and wood preservatives. The term polyhalogenated aromatics as used herein may include any polyhalogenated aromatic known in the art, for example polychlorinated biphenyls, polybrominated biphenyls, halogenated benzenes, halogenated biphenyls, polychlorinated dibenzofurans, chlordane and halogenated polynuclear aromatics. In most instances, the compounds will be polychlorinated biphenyls, either alone or as mixtures with hydrocarbon or silicon-based oils such as transformer oils, ballast oils, heat transfer fluids, or lubricants. The compounds to be treated may also include contaminated solid wastes previously treated with a suitable diluent and various halogenated organic wastes including those of pesticides and wood preservatives. The elimination of polyhalogenated biphenyls from matrices such as soil and electrical equipment can also be achieved by combining this process with other commercially available decontamination technologies. Both low and high level waste streams can be treated.

Low level polyhalogenated aromatics includes fluids containing between about 1 mg/kg and 50,000 mg/kg of polyhalogenated aromatics, and preferably between about 2 mg/kg and 5,000 mg/kg of polyhalogenated aromatics. High level polyhalogenated aromatics includes fluids, semi-solids and other materials containing between about 50,001 mg/kg and 100% polyhalogenated aromatics, and preferably between about 100,000 mg/kg and 100% polyhalogenated aromatics.

Alkali Dispersions

The processes of the present invention will be effective using dispersions formed with various alkali metals. The term alkali and alkali metal as used herein may include any alkali metal that can be used in the context of the present invention, such as lithium, sodium or potassium, and hydroxides thereof, with sodium and lithium being preferred. In most instances, the alkali metal will be added in the form of a fine dispersion that will be incorporated in the contaminated solution to be treated.

The alkali metal is prepared as a dispersion in a suitable solvent, such as oil, in the form of a finely divided powder, or in small pieces, free of any surface coatings. The processes through which alkali metal dispersions are prepared is well known to those skilled in the art.

In other embodiments, alkaline earth metals such as calcium may produce significant dehalogenation of polyhaloaromatics such as PCBs when treated in a polar solvent such as methanol with excess calcium, preferably a 20-fold excess based on the stocchiometric amount of the chlorine present in PCBs.

Parameter Selection

The process of the invention may be better regulated by the most efficient selection of reaction parameters, and in particular, the alkali/halogen ratio. Hence, as a first step, one may determine the level of PCB in a given lot of contaminated liquid which is to be purified, for example oil.

Analyses known in the art may then be used to determine the time and excess sodium required to dehalogenate the PCBs to the desired level. Assuming, as is usually the case, that labour cost is significant compared to sodium cost, and given the desirability of reducing duration of exposure to hazardous materials, it is often desirable to increase sodium excess in order to accelerate the reaction and decrease the time required to reach the target PCB level.

Preferred reaction temperatures are moderatively elevated temperatures, typically between 50° C. and 150° C. and preferably between 90° C. and 130° C.

Thermodynamic Relationships

Temperature change due to Chemical Reaction

The change in temperature in the reacting mixture due to a chemical reaction is given by:

$$Q_{Reaction}(KJ)=M_{reactants}*Cp_{reactants}*\Delta T_{reactants} \quad \text{Equation 1}$$

Where $Q_{Reactant}$ is the heat released by the chemical reaction in KJ, $M_{reactants}$ is the total mass of reactants, $Cp_{reactants}$ is the average heat capacity of the reacting mixture and $\Delta T_{reactants}$ is the variation in temperature of the reacting mixture. Under an exothermic reaction (present case), the final temperature of the mixture is greater than its initial temperature.

This relationship assumes that the heat capacity of the mixture is constant, that there are no other sources of heat or heat losses. To facilitate the calculations, the heat capacity of mineral oil of 1.84 KJ/kg C. has been used for this application.

Heat Release by PCB-Sodium Reaction

The energy release by the PCB-sodium reaction can be estimated by the enthalpy of formation for the different bonds created and broken during this reaction. Thus, assuming that we have pentachlorobiphenyl in the low level PCB contaminated mineral oil, the reaction takes the form of:

$$5H+5Na-\text{pentachlorobiphenyl}\rightarrow 5NaCl+\text{polyphenyls}$$

The enthalpy of formation for the following bonds is given in "Handbook of Chemistry and Physics", CRC Press, 1981–82:

| | |
|---|---|
| Cl—C | 307 (KJ/mole) |
| Na—Cl | 407 (KJ/mole) |
| C—H | 337 (KJ/mole) |

Therefore for the PCB-sodium reaction, the heat generated is given by:

$$Q_{react}=5*(Na—Cl)+5*(C—H)-5*(Cl—C) \quad \text{Equation 2}$$

For a total weight of 1 Kg (3.07 moles) of pentachlorobiphenyl in the oil, the calculated heat release by the reaction of pentachlorobiphenyl and sodium in the oil mixture is 6,708 KJ.

Knowing the heat release by the PCB-sodium reaction, the temperature in the reacting mixture can then be calculated. The equation used to calculate the temperature increase is similar to equation 1. Thus, for the total mass of reactants of 100 kg, the heat capacity of the oil (1.84 KJ/kg° C.) and the 6,708 KJ of heat released by the reaction, the increase in the reactant temperature of 36.5° C.

Heat Release by Excess Sodium Neutralization

The excess of sodium reagent used in this PCB destruction process may be neutralized before removing the by-products from the system. Water is usually used as a neutralizing reagent for sodium. The heat released by the sodium-water reaction can also be calculated using the enthalpy of formation of the different chemical bonds involved in this reaction. For the reaction:

$$Na+H_2O\rightarrow NaOH+\tfrac{1}{2}H_2$$

Thus, $$Q_{Na}=426-248 \text{ (KJ/mole)}$$

The amount of excess sodium added to the reactor varies based on PCB concentration, PCB type and reaction temperature. Assuming that the Sodium-PCB molar ratio used for the reaction was 30, after all PCBs have been destroyed the amount of excess sodium in the reactor is 1.7 kg or 76.7 moles. The reaction of this excess sodium with water generates 13,653 KJ.

The temperature increase due to the heat generated by the sodium-water reaction is 74.2° C.

Based on these calculations and knowing that most commercial, chemical PCB destruction processes using sodium dispersion are carried out in the range of 70 to 100° C., it is concluded that the heat generated by the system would make the temperature of the reacting medium (mineral oil) rise above the flash point of the oil (145° C.). Therefore, in order to control the reactants' temperature, the system has to be cooled using any direct or indirect mechanism.

The present inventors have thus developed a procedure to simultaneously destroy high and low level PCB contaminated fluids using sodium dispersion or a similar exothermic type of chemical reaction. The invention will be further illustrated as it applies to the decontamination of low level PCB contaminated mineral oil and to the destruction of pure PCB waste using low level PCB contaminated mineral oil as a cooling fluid (Example 1), and as it applies to previously decontaminated low level PCB contaminated mineral oil with relatively high water content used a cooling fluid (Example 2).

EXAMPLE 1

Reactant temperature controlled by low level PCB contaminated mineral oil

Four hundred litres (344 kg) of low level PCB contaminated mineral oil (100 mg/kg of Aroclor 1254) is first loaded into reaction vessel (1.700-litre capacity). This oil is heated up to low level reaction temperature (about 90° C.). After reaching desired temperature, 40.75 kg of sodium dispersion reagent (40% w/w sodium and 60% mineral oil) is added to reaction mixture. This amount of sodium is equivalent to 1.5 times the stoichiometric Na—Cl ratio for 40 kg of pure PCBs (Aroclor 1242) to be destroyed in the batch. Since usually the low level PCB contaminated mineral oil found in power transformers is accompanied by similar amount of chlorobenzene, the amount of chlorine actually present in the blend has been estimated to be two times that contained in the PCBs. This relatively small amount of chlorine (0.04 kg), reacts with sodium to generate about 477 KJ of heat, increasing the reactant temperature by about 0.7° C.

Following the addition of sodium dispersion into the reactor, 20 kg of pure PCBs Allowing the mass of reactants to heat up to a maximum of 125° C., the amount of heat absorbed by the reactants before the cooling oil is added is 14,897 KJ. Therefore the difference between the heat generated by the reaction and that absorbed by the reacting blend, that is 88,505 KJ, must be absorbed by an external heat sink. The present inventors have achieved this cooling by adding oil to the reaction vessel. Low level PCB contaminated mineral oil is used as a cooling medium. Assuming that the cooling oil is stored at 20° C. and contains 100 mg/kg of PCBs (Aroclor 1254), the amount of cooling oil required to cool down the mixture to a target temperature of 125° C. would be 458 kg of oil.

Applying equation 1, with $Q_{Reaction}$ equals to 88,505 KJ, $Cp_{reactants}$ equals to 1.84 KJ/(kg° C.) and $\Delta T_{reactants}$ equals to 105° C., the mass of cooling oil required to cool down the blend becomes:

$$M_{cooling\ oil}=88{,}505/(1.84*105)=458\ \text{kg}$$

The PCBs and chlorobenzene contained in the cooling oil would react with sodium in the reaction vessel producing 635 KJ. Assuming that the low level, PCB contaminated oil also contains about 200 mg/kg of water, the heat generated by the water-sodium reaction would be about 906 KJ. The combined heat generated by PCBs, chlorobenzene and water in the cooling oil (1,541 KJ) is much lower than the about 88,486 KJ of heat which is absorbed by the oil. This difference in the heat generated and heat absorbed by the oil produced the desired cooling effect of the oil in the reaction mixture. The cooling oil and PCB pure waste have to be added into the reaction vessel at a controlled rate to maintain the temperature within the desired operating range.

After completing the addition of the 20 kg of pure PCBs and ensuring the system is at constant temperature, the second and final batch of 20 kg of pure PCBs is prepared for addition into reaction vessel. The amount of additional cooling oil required to maintain the reactants at 140° C. is 321 kg. The pure PCB waste and cooling oil are added in the same manner as before, controlling and maintaining the temperature at or below 140° C.

The heat generated by chlorine-sodium and water-sodium reactions from the material in the second batch of cooling oil is about 1081 KJ. This heat is also much lower than the heat absorbed by the cooling oil (70,877 KJ), producing a net decrease in the reactants' temperature.

The total mass of reactants after the second injection of pure PCB waste and cooling oil has become 1,204 kg. The reacting mixture is stirred or otherwise agitated, usually for about 30 to 60 minutes, in the reactor to allow for completion of the PCB destruction reaction. Although the reactor is usually insulated, heat losses still occur. Based on the inventor's experience, heat losses in the reactor during the last stage of the reaction makes the temperature drop by about 10 degrees.

After ensuring that no PCBs are contained in the reacting mixture (samples are properly taken and analyzed), the excess sodium in the system has to be neutralized. To initiate neutralization stage and to maintain temperature within safety margin, the reactant's temperature must be dropped to about 110° C. To cool down the reaction mixture and to avoid the potential for cross-contamination non-contaminated mineral oil can be added to reaction vessel. This type of oil would be available for use from previous decontamination batches. Previously decontaminated oil, however, would contain trace amount of water from the sodium neutralization stage. Assuming that this clean oil contains water in a concentration of 200 mg/kg, the amount of oil required to drop the reactants' temperature by 20° C. would be 192 kg.

Based on mass balanced, about 4 kg of water is required to neutralized excess of sodium (4.99 kg). The 4.99 kg of sodium left in the system would generate about 38,644 KJ as it reacts with water. This heat raises the temperature of the mixture to 125° C. The total mass of by-product at the end of the process is 1406 kg or 1635 litres.

The use of this procedure allows the simultaneous decontamination of 1123 kg (1306 litres) of low level PCB contaminated mineral oil and the destruction of 40 kg of pure PCBs (Aroclor 1242) in about 1.5 hours in a 1,700 litre reactor. Because the chemical reaction destroying the PCBs is carried out at relatively low temperature, the decontaminated mineral oil (1306) can re-used in electrical transformers or can be used as a coolant in further decontamination reactions.

EXAMPLE 2

Reactant temperature controlled by previously decontaminated, wet mineral oil

Four hundred litres (344 kg) of low level PCB contaminated mineral oil (100 mg/kg of Aroclor 1254) is first loaded into the reaction vessel (1,700-litre capacity). This oil is heated up to low level reaction temperature (about 90° C.). After reaching desired temperature, 40.75 kg of sodium dispersion reagent (40% w/w sodium and 60% mineral oil) is added to reaction mixture. This amount of sodium is equivalent to 1.5 times the stoichiometric Na—Cl ratio for 40 kg of pure PCBs (Aroclor 1242) to be destroyed in the batch. Since usually the low level PCB contaminated mineral oil found in power transformers is accompanied by similar amount of chlorobenzene, the amount of chlorine actually present in the blend has been estimated to be two times that contained in the PCBs. This relatively small amount of chlorine (0.04 kg) reacts with sodium to generate about 477 KJ of heat, increasing the reactant temperature by about 0.7° C.

Following the addition of sodium dispersion into the reactor, 20 kg of pure PCBs (Aroclor 1242) is added into the reaction vessel. Because the amount of heat (103,402 KJ) generated by this amount would raise the reactants' temperature above the flash point of the oil, the contents of the reaction vessel must be cooled. The present inventors have cooled the contents by adding cooling fluid to the reaction vessel. Mineral oil previously decontaminated in the process and containing dissolved water is used as a cooling medium in this process. Assuming that the wet cooling oil is stored at 20° C. and contains 200 mg/kg of water, the amount of cooling oil required to maintain the reacting mixture at 125° C. would be 458 kg of oil. The water contained in the cooling oil would generate about 906 KJ when reacting with sodium in the blend. As in the previous case, the heat generated by the contaminants in the cooling oil (only water in this Example) is much lower than the heat absorbed (88,486 KJ) by the oil, producing a net decrease in the reactants' temperature. The cooling oil and PCB pure waste are added into the reaction vessel at a controlled rate to maintain the temperature within the desired operating range.

After completing the addition of the 20 kg of pure PCBs and ensuring the system is maintained at constant temperature, the second and final batch of 20 kg of pure PCBs is prepared for addition into reaction vessel. The amount of additional cooling oil required to maintain the reactants at 140° C. is 321 kg. The heat generated by the water-sodium reaction by the water contained in this cooling is only 635 KJ. This heat is much lower than the heat absorbed by cooling oil (70,877 KJ), producing the desired cooling of the reaction mixture. The pure PCB waste and cooling oil are added in the same manner as before, controlling and maintaining the temperature at or below 140° C.

The total mass of reactants after the second injection of pure PCB waste and cooling oil has become 1,204 kg. The reacting mixture is stirred, usually for about 30 to 60 minutes, in the reactor vessel to allow for completion of the PCB destruction reaction. Heat losses in the reactor makes the temperature drop by about 10 degrees.

After ensuring that no PCBs are left un-reacted in the reaction vessel, the excess sodium in the system has to be neutralized. To initiate neutralization stage, the reactant's temperature must be dropped to about 110° C. To achieve this temperature drop of about 20° C., 192 kg of non-contaminated mineral oil is added to the system. Based on mass balanced, about 4 kg of water is required to neutralized excess of sodium (5.22 kg). The 5.22 kg of sodium left in the system would generate about 40,390 KJ as it reacts with water. This heat raises the temperature of the mixture to 126° C. The total mass of by-product at the end of the process is 1399 kg or 1626 litres.

The use of this procedure allows the simultaneous decontamination of 344 kg (400 litres) of low level PCB contaminated mineral oil and the destruction of 40 kg of pure PCBs (Aroclor 1242) in about 1.5 hours in a 1,700 litre reactor. Because the chemical reaction destroying the PCBs is carried out at relatively low temperature, the decontaminated mineral oil and cooling oil can be re-used in electrical transformers or can be based as a cooling medium in further decontamination reaction.

We claim:

1. A method for decontaminating a contaminated inert fluid which is contaminated with between 1 mg of polyhalogenated aromatic/kg of inert fluid and 50,000 mg of polyhalogenated aromatic/kg of inert fluid while simultaneously decontaminating a material which is contaminated with between 50,001 mg of polyhalogenated aromatic/kg of inert fluid and 100% of polyhalogenated aromatic, by an exothermic polyhalogenated aromatic destroying reaction, comprising:

i) placing in a vessel the following contents:
   a. an inert solvent;
   b. a dispersion of an alkali metal; and
   c. said material;

ii) adding to the contents of said vessel said contaminated inert fluid in a quantity sufficient to maintain temperature of said contents below flash point of said contents; and iii) allowing a reaction between said dispersion of said alkali metal and said polyhalogenated aromatic to proceed until said contaminated inert fluid and said material are decontaminated to produce decontaminated inert fluid.

2. A method as claimed in claim 1, further comprising, contemporaneous with or subsequent to steps (ii) and (iii), the steps of:

(iv) placing water in said vessel to neutralize said contents and (v) placing inert fluid in said vessel, in a quantity sufficient to maintain the temperature of said contents below flash point of said contents.

3. A method as claimed in claim 2, wherein at least part of said water is in said inert fluid.

4. A method as claimed in claim 3, wherein, during step (ii), contaminated inert fluid is added into said vessel in a quantity sufficient to maintain temperature of said contents below a temperature that would denature said inert fluid, and, subsequent to step (iii), recovering said inert fluid as useable inert fluid.

5. A method as claimed in claim 2, wherein, during step (ii), contaminated inert fluid is added into said vessel in a quantity sufficient to maintain temperature of said contents below a temperature that would denature said inert fluid, and, subsequent to step (iii), recovering said inert fluid as useable inert fluid.

6. A method as claimed in claim 2, further comprising, prior to steps (iv) and (v) adding clean inert fluid to further cool contents of said vessel.

7. A method as claimed in claim 1, wherein, during step (ii), contaminated inert fluid is added into said vessel in a quantity sufficient to maintain temperature of said contents below a temperature that would denature said inert fluid, and, subsequent to step (iii), recovering said inert fluid as useable inert fluid.

8. A method as claimed in claim 7, wherein said useable inert fluid is recovered by, subsequent to step (iii), allowing reactants to settle out of said inert fluid and subsequently recovering said useable inert fluid.

9. A method as claimed in claim 1, further comprising, prior to steps (iv) and (v) adding clean inert fluid to further cool contents of said vessel.

10. A method as claimed in claim 1, wherein prior to conclusion of step (i), air is displaced from said vessel.

11. A method as claimed in claim 10, wherein said air is displaced with a non-combustible gas.

12. A method as claimed in claim 1, wherein said inert solvent is contaminated with between 1 mg/kg and 50,000 mg/kg of polyhalogenated aromatic.

13. A method as claimed in claim 1, wherein said alkali dispersion is obtained from an alkali selected from the group consisting of lithium, potassium and sodium.

14. A method as claimed in claim 1, wherein said polyhalogenated aromatic is selected from the group consisting of halogenated benzenes, halogenated biphenyls, polychlorinated dibenzofurans, chlordane and halogenated polynuclear aromatics.

15. A method as claimed in claim 14, wherein said polyhalogenated aromatic is PCB.

16. A method as claimed in claim 15, wherein prior to conclusion of step (i), said contents are heated to about 90° C.

17. A method as claimed in claim 15, wherein during step (ii), said temperature is maintained below about 140° C.

18. A method as claimed in claim 14, wherein said halogenated biphenyls are selected from the group consisting of polychlorinated biphenyls and polybrominated biphenyls.

19. The method as claimed in claim 1, wherein said inert solution is organic solvent.

20. The method as claimed in claim 19 wherein said organic solvent is mineral oil.

* * * * *